US008107867B2

(12) United States Patent
Funabiki

(10) Patent No.: US 8,107,867 B2
(45) Date of Patent: Jan. 31, 2012

(54) IMAGE FIXING DEVICE USING A BELT-DRIVING METHOD, AND IMAGE FORMING APPARATUS USING THE SAME IMAGE FIXING DEVICE

(75) Inventor: Hiroshi Funabiki, Uenohara (JP)

(73) Assignee: Konica Minolta Business Technologies, Inc. (JP)

( * ) Notice: Subject to any disclaimer, the term of this patent is extended or adjusted under 35 U.S.C. 154(b) by 386 days.

(21) Appl. No.: 12/419,146

(22) Filed: Apr. 6, 2009

(65) Prior Publication Data

US 2009/0257767 A1 Oct. 15, 2009

(30) Foreign Application Priority Data

Apr. 9, 2008 (JP) ..... 2008-101330

(51) Int. Cl.
*G03G 15/20* (2006.01)

(52) U.S. Cl. ..... 399/329; 399/33; 399/320; 399/328; 399/330

(58) Field of Classification Search ..... 399/329, 399/328, 338
See application file for complete search history.

(56) References Cited

U.S. PATENT DOCUMENTS

| | | | | |
|---|---|---|---|---|
| 7,027,762 | B2 * | 4/2006 | Omata et al. | 399/309 |
| 2006/0165442 | A1 * | 7/2006 | Kobayashi et al. | 399/301 |
| 2007/0059061 | A1 * | 3/2007 | Katayama et al. | 399/329 |
| 2007/0059064 | A1 * | 3/2007 | Okuda et al. | 399/329 |
| 2007/0092308 | A1 * | 4/2007 | Miyamoto et al. | 399/301 |
| 2008/0112714 | A1 * | 5/2008 | Fujihara | 399/18 |
| 2008/0317524 | A1 * | 12/2008 | Takahashi et al. | 399/329 |
| 2009/0035034 | A1 * | 2/2009 | Nagase | 399/329 |

FOREIGN PATENT DOCUMENTS

| | | | |
|---|---|---|---|
| JP | 5-201578 | A | 8/1993 |
| JP | 5-341673 | A | 12/1993 |
| JP | 8-137351 | A | 5/1996 |
| JP | 2000-281233 | A | 10/2000 |
| JP | 2007-132986 | A | 5/2007 |

OTHER PUBLICATIONS

JPO Appl. 2008-101330 Search Report dated Feb. 26, 2010.*
JPO Appl. 2008-101330 Memorandum of Decision to Grant dated Mar. 2, 2010.*

* cited by examiner

*Primary Examiner* — David Gray
*Assistant Examiner* — David Bolduc
(74) *Attorney, Agent, or Firm* — Cantor Colburn LLP

(57) ABSTRACT

An image fixing device, having a belt-driving method to drive an endless belt which is entrained about at least two supporting members, including: a first supporting member on which a light transmitting area is provided; a heater which is housed within the first supporting member; a sensor which is mounted at a position to detect light rays, emitted from the heater and passed through the light transmitting area; and a control section which is configured to detect a lateral displacement of the endless belt in a width direction, based on a detected result of the light rays, detected by the sensor.

9 Claims, 6 Drawing Sheets

IMAGE FIXING DEVICE USING A BELT-DRIVING METHOD, AND IMAGE FORMING APPARATUS USING THE SAME IMAGE FIXING DEVICE

CROSS REFERENCE TO RELATED APPLICATION

This application is based on Japanese Patent Application No. 2008-101,330 filed on Apr. 9, 2008, with the Japanese Patent Office, the entire content of which is hereby incorporated by reference.

TECHNICAL FIELD

The present invention relates to an image fixing device using a belt-driving method in which an endless belt is entrained about at least two supporting members, and to an image forming apparatus using the same image fixing device.

BACKGROUND OF THE INVENTION

In recent years, in the image forming apparatuses, such as copying machines, printers, and facsimiles, the image fixing device using the belt-driving method is well known, in which an image fixing process is conducted on a recording member to carry toner images formed of heat-melting resins.

The image fixing device using the belt-driving method is structured in such a manner that while not-yet fixed toner images face the surface of the endless belt, the recording member carrying said not-yet fixed toner images is fed onto a surface of the endless belt which is kept within a scope of predetermined temperature, after that, a pressure applying roller, facing the image fixing belt, pushes said not-yet fixed images against the image fixing belt.

In consequence, due to said pressure applying function and heat applying function, conducted by the image fixing belt and the pressure applying roller, the toner images, carried on the recording member, are heated and fixed onto the recording member.

Further, concerning the image fixing device, using the belt-driving method, in order to overcome various problems (which are such as an overrunning belt upon the roller, a damaged image fixing belt, or the like) due to meandering of the image fixing belt, that is, abnormal lateral displacement of the image fixing belt in its width direction (which includes deviation of the image fixing belt toward one side in the course of the rotation), various technologies have been introduced in numerous applications as listed below.

Firstly, Unexamined Japanese Patent Application Publication No. H8-137,351, teaches a technology in that an optical sensor, provided above the edge of the image fixing belt, detects the light rays reflected from the surface of the image fixing belt, whereby any lateral displacement of the image fixing belt in the width direction (which is the deviation of the belt toward one side) is detected.

Secondarily, Unexamined Japanese Patent Application Publication Nos. H5-201,578 and H5-341,673 teach a technology in that an actuator detects the edge of the image fixing belt in the width direction, whereby the lateral displacement of the image fixing belt in the width direction (which is the deviation of the belt toward one side) is detected.

Thirdly, Unexamined Japanese Patent Application Publication No. 2000-281,233 teaches a technology in that an edge of a supporting roller is formed as a member separated from a central portion of the supporting roller, and said edge of the supporting roller rotates independently of the central portion of the supporting roller, whereby any lateral displacement of the image fixing belt in the width direction (which is the deviation of the belt toward one side) is detected, based on the driving conditions (which are driving condition changing due to contact/non-contact with the belt) at the edge of the supporting roller.

Fourthly, Unexamined Japanese Patent Application Publication No. 2007-132,986 teaches a technology in that the image fixing belt, being an electrically conductive belt, runs between paired brushes to be sandwiched, so that said paired brushes electrically detect the edge of the image fixing belt, whereby any lateral displacement of the image fixing belt in the width direction (which is the deviation of the belt toward one side) is detected.

However, the above-mentioned Patent Applications include various problems, as described below.

Firstly, the technology taught in Unexamined Japanese Patent Application Publication No. H8-137,351 includes the problem in that in order to detect the light rays reflected from the image fixing belt, the optical sensor is mounted near an edge of the image fixing belt, whereby the optical sensor tends to be heated, which can result in abnormal operation.

Further, concerning the technology taught in Unexamined Japanese Patent Application Publication No. H8-137,351, the optical sensor, which is mounted near the edge of the image fixing belt, tends to adversely detect the light rays, due to paper powder, stray toner particles, and oil used to lubricate contacting portions, and used to separate paper from the image fixing belt, which can become major problems.

Secondarily, concerning the technology taught in Unexamined Japanese Patent Application Publication Nos. H5-201,578 and H5-341,673, since an actuator tends to come into contact with the edge of the image fixing belt, the image fixing belt changes in its shape, which results in reduced operation life, can also become a major problem.

Thirdly, concerning the technology taught in Unexamined Japanese Patent Application Publication No. 2000-281,233, due to a dirty inner periphery of the image fixing belt, or a dirty edge of the supporting roller, as well as deformation of said edge, the edge of the supporting roller tends to deliver decreased driving force, whereby only detected is major adverse deviation of the belt toward one side, which of course is a major problem. Specifically, since tensile force is concentrated onto the edge of the image fixing belt, the image fixing belt deforms and curves like a flare due to the long operation, whereby the driving force of a rotation detecting section, generated by the image fixing belt, tends to adversely decrease.

Fourthly, concerning the technology taught in Unexamined Japanese Patent Application Publication No. 2007-132,986, since the image fixing belt cannot help being dirty from oil droplets or toner particles, it is a major problem to use the image fixing belt as a part of an electrical conductive route.

SUMMARY OF THE INVENTION

Since the present invention has been achieved to overcome the above-mentioned problems, an object of the present invention is to offer the image fixing device using the belt-driving method and the image forming apparatus using the same image fixing device, in which lateral displacement of the image fixing belt in the width direction (which is the deviation of the belt toward one side) is detected.

An image fixing device of the present invention, having a belt-driving method to drive an endless belt which is entrained about at least two supporting members, includes:

a first supporting member through which a light transmitting area is provided;

a heater which is housed within the first supporting member;

a sensor which is mounted at a position where the sensor detects light rays, which are emitted from the heater, and passed through the light transmitting area; and a control section which is configured to detect any lateral displacement of the endless belt in a width direction, based on a detected result of the light rays, detected by the sensor.

BRIEF DESCRIPTION OF THE DRAWINGS

Embodiments will now be described, by way of examples only, with reference to the accompanying drawings which are meant to be exemplary, not limiting, and wherein like elements are numbered alike in the several figures, in which.

DETAILED DESCRIPTION OF THE PREFERRED EMBODIMENTS

First Embodiment

Figure 1:
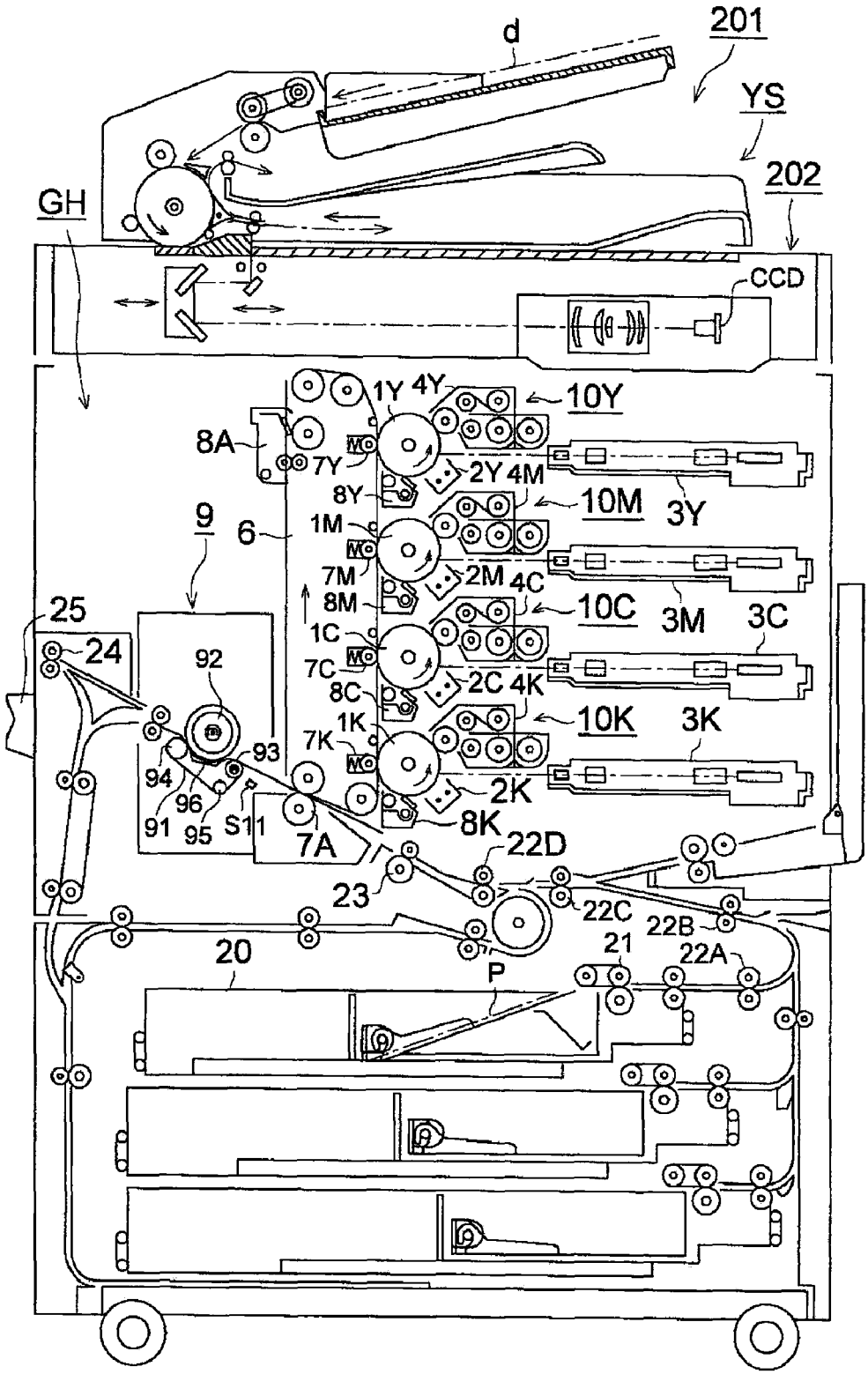
FIG. 1 is a whole structuring view of the image forming apparatus, relating to a first embodiment of the present invention.

While referring to FIG. 1, the image forming apparatus relating to the first embodiment of the present invention will now be detailed. The image forming apparatus relating to the present embodiment is structured of printer section GH and image reading device YS.

Printer section GH is termed as a "tandem type color image forming apparatus", which is structured of image forming sections 10Y, 10M, 10C and 10K, intermediate transfer body 6, being a looped belt, sheet supplying section 20, and image fixing device 9.

Image reading device YS, structured of automatic document feeding device 201 and scanning exposure device 202, is installed on a top portion of printer section GH.

Original document sheet "d", placed on a document platen of automatic document feeding device 201, is conveyed by a conveyance section, after which the images carried on a single surface or on both surfaces of document sheet "d" is scanned and exposed by an optical system of scanning exposure device 202, whereby the images are read by line image sensor CCD.

Signals, which have been photo-electrically converted by line image sensor CCD, are processed, employing such as an analog process, an A/D conversion process, a shading process, and an image compressing process, after which said signals are sent to exposure sections 3Y, 3M, 3C and 3K.

Image forming section 10Y, which forms the yellow toner images, has charging section 2Y, exposure section 3Y, developing device 4Y, and cleaning section 8Y, all of which are arranged around photoconductor 1Y.

Image forming section 10M, which forms the magenta toner images, has charging section 2M, exposure section 3M, developing device 4M, and cleaning section 8M, all of which are arranged around photoconductor 1M.

Image forming section 10C, which forms the cyan toner images, has charging section 2C, exposure section 3C, developing device 4C, and cleaning section 8C, all of which are arranged around photoconductor 1C.

Image forming section 10K, which forms the black toner images, has charging section 2K, exposure section 3K, developing device 4K, and cleaning section 8K, all of which are arranged around photoconductor 1K.

A set of charging section 2Y and exposure section 3Y, a set of charging section 2M and exposure section 3M, a set of charging section 2C and exposure section 3C, and a set of charging section 2K and exposure section 3K, each set structures a latent image forming section.

In addition, developing devices 4Y, 4M, 4C and 4K include a dual component developer including toners of yellow (Y), magenta (M), cyan (C) and black (K), and appropriate carriers.

Intermediate transfer body 6 is entrained about a plurality of rollers so that it can rotate.

Transfer sections 7Y, 7M, 7C and 7K primarily transfer the color toner images, respectively formed by image forming sections 10Y, 10M, 10C and 10K, onto rotating intermediate transfer body 6, whereby each color image is superposed, so that a full-color image is formed on intermediate transfer body 6.

After recording sheet P is supplied from any one of sheet supplying cassettes 20 by sheet supplying section 21, recording sheet P is sequentially conveyed to transfer section 7A, by paired sheet supplying rollers 22A, 22B, 22C and 22D, as well as paired registration rollers 23. That is, transfer section 7A is configured to transfer the full-color image onto recording sheet P (which is the secondary transfer operation).

After transfer section 7A has transferred the full-color image onto recording sheet P, transfer section 7A separates recording sheet P using a sharp-angle conveyance. After that, cleaning section 8A removes any stray toner particles remaining on intermediate transfer body 6.

Figure 2:
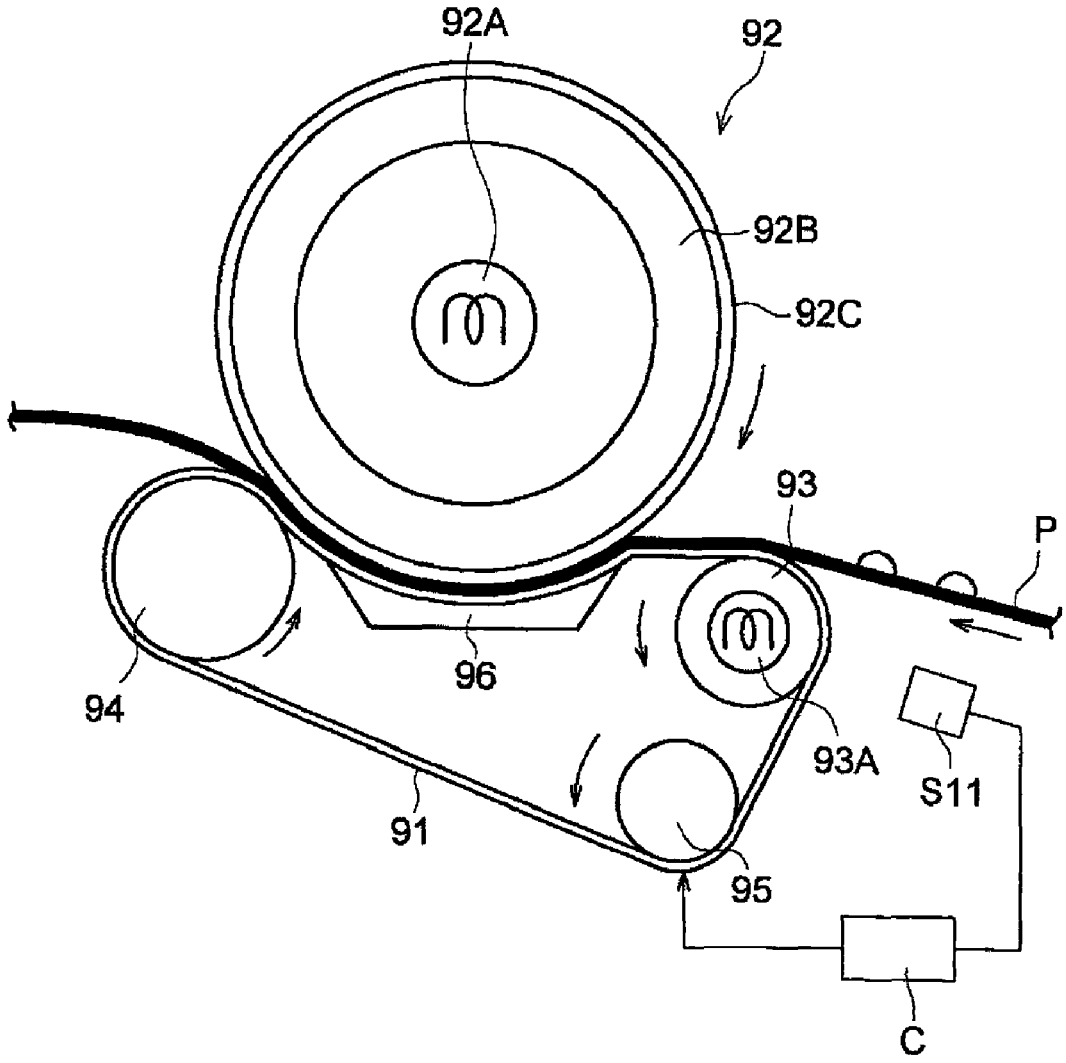
FIG. 2 is a cross-sectional view of the image fixing device, relating to the first embodiment of the present invention.

Image fixing device 9 includes belt supporting roller 93, belt meander controlling roller 95, sheet separating roller 94, image fixing belt 91 as an endless belt, which is entrained about above-described rollers 93, 94 and 95, pressure applying pad 96 which presses image fixing roller 92 through image fixing belt 91, and control section C, shown in FIG. 2.

At a nipping portion, which is formed between image fixing belt 91 and image fixing roller 92, image fixing device 9 applies heat and pressure onto a not-yet fixed full-color toner image carried on recording sheet P, and thereby generates a fixed full-color image.

After that, recording sheet P carrying the fixed full-color image is nipped by paired ejection rollers 24, and conveyed to sheet ejection tray 25, which is installed on the exterior of the image forming apparatus.

The above explanation is for a full-color image forming apparatus, however the present invention is also applicable to a monochromatic image forming apparatus.

Image fixing device 9, relating to the first embodiment of the present invention, will now be detailed, while referring to FIGS. 2-6.

Image fixing device 9, relating to the present embodiment, functions as the belt driving device in which endless fixing belt 91 is driven, while being entrained about at least two supporting members.

In FIG. 2, endless fixing belt 91 is driven, while being entrained about belt supporting roller 93, belt meander controlling roller 95, and sheet separation roller 94.

For example, in image fixing belt 91, a heat-resistant resin belt is used as a base belt, which may be made of polyimide, at a thickness of 70 μm. A heat-resistant silicon rubber, at a thickness of 500 μm, is used as an elastic layer to cover the periphery surface of the base belt. A tube of PFA (which is perfluoroalkoxy), at a thickness of 30 μm, is used as the sheet separation layer.

Pressure applying pad 96 pushes against image fixing roller 92 through image fixing belt 91, as described above, which is formed for example of molded silicon rubber.

Image fixing roller 92 houses halogen lamp 92A, serving as a heating means (being a heater) to heat image fixing belt 91. Image fixing roller 92 is formed of aluminum-molded body 92B, being a cylindrical hollow body, and its surface is covered with a silicon layer with the thickness of 1.5 mm, and said surface is further covered with heat-resistant PFA tube 92C.

Sheet separation roller 94, mounted near the outlet of image fixing device 9, rotates counterclockwise so that recording sheet P is separated from image fixing belt 91. Sheet separation roller 94 is formed for example of a solid stainless steel cylindrical body.

Belt meander controlling roller 95, formed of a solid stainless steel cylindrical solid body, moves at perpendicular angle to the width direction of image fixing belt 91, so that the displacement across the width direction of image fixing belt 91 (which means the deviation of the belt toward one side) can be corrected.

Belt supporting roller 93, mounted near the inlet of image fixing device 9, is formed for example of a stainless steel cylindrical hollow body, which houses halogen lamp 93A, serving as a heating means (being the heater) to heat image fixing belt 91.

Figure 3:
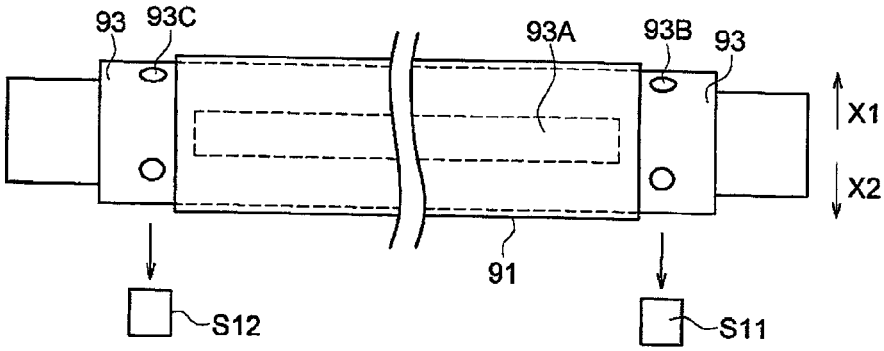
FIG. 3 shows a positional relationship between the belt and the roller including a heater of the image fixing device of the first embodiment of the present invention.
Figure 4:
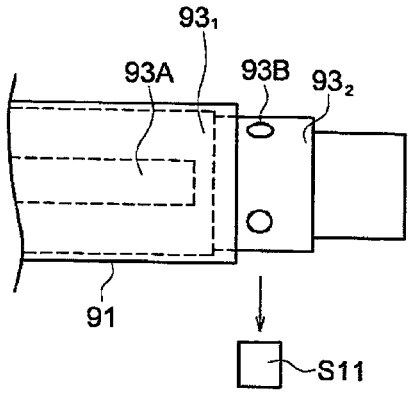
FIG. 4 shows another positional relationship between the belt and the roller including a heater of the image fixing device of the first embodiment of the present invention.
Figure 5:
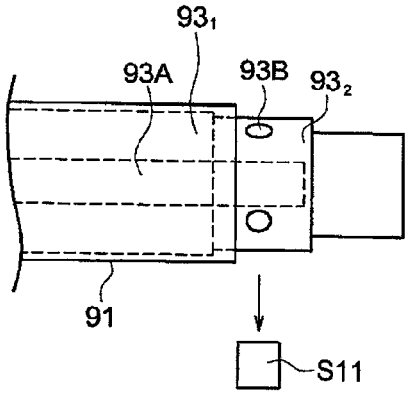
FIG. 5 shows still another positional relationship between the belt and the roller including a heater of the image fixing device of the first embodiment of the present invention.
Figure 6:
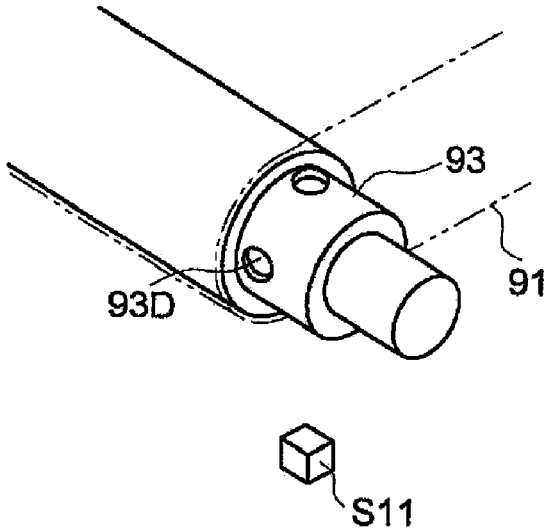
FIGS. 6(A) and 6(B) show a belt driving device mounted on the image fixing device as variation 1 of the first embodiment of the present invention.
Figure 6:
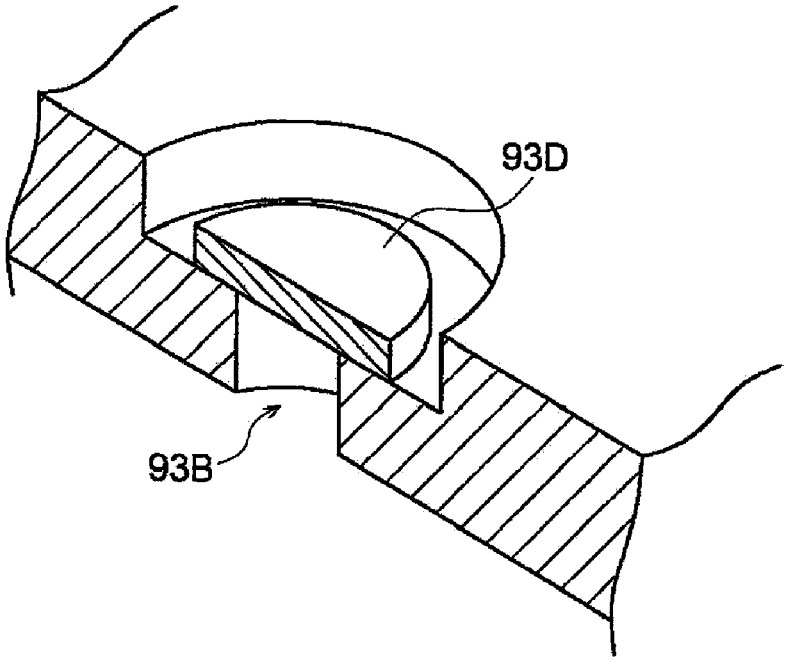

As shown in FIGS. 3-5, a light transmitting area is provided on belt supporting roller 93 (which serves as a first supporting member). FIGS. 3-5 are front views of belt supporting roller 93, being viewed from the inside of image fixing belt 91.

In detail, the light transmitting areas are formed of at least two through-holes (being first through-hole 93B and second through-hole 93C, are provided at each end of belt supporting roller 93, respectively).

In the present embodiment, as shown in FIG. 3, first through-hole 93B, which represents one or plural through-holes, is provided on the right portion (when viewing roller 93 from the interior of fixing belt 91) of belt supporting roller 93, while through-hole 93C, which represents one or plural through-holes, is provided on the left portion (when viewing roller 93 from the interior of fixing belt 91) of belt supporting roller 93.

At the right and left portions of belt supporting roller 93 of the present embodiment, three first through-holes 93B are provided with a distance of 120 degrees between at the right portion, and three second through-holes 93C are also provided with a distance of 120 degrees between at the left portion. However, the number of first through-holes 93B and the number of second through-holes 93C can be appropriately selected, based on the displacement speed of image fixing belt 91 across its width, and also based on the lighting ratio of halogen lamp 93A.

In this case, first through-hole 93B and second through-hole 93C should be structured to face light receiving sensors S11 and S12, respectively, while halogen lamp 93A lights based on: the number of first through-holes 93B and the number of second through-holes 93C; the displacement speed of image fixing belt 91 across the width; and the lighting ratio of halogen lamp 93A.

For example, while halogen lamp 93A is energized, the minimum continuous lighting time and a forced lighting time of halogen lamp 93A may be determined so that first through-hole 93B and second through-hole 93C face light receiving sensors S11 and S12.

Further, in image fixing device 9 relating to the present embodiment, in order to increase the lighting ratio of halogen lamp 93A, while outputting minimum energy to heat image fixing belt 91, halogen lamp 93A is typically installed within belt supporting roller 93.

In this case, an appropriate halogen lamp 93A, which can output the minimum energy, is preferentially selected to use in image fixing device 9 of the present embodiment.

The distance between first through-hole 93B and second through-hole 93C, which is measured in the width direction of belt supporting roller 93, is greater than the width of image fixing belt 91.

Further, light receiving sensors S11 and S12 are installed at positions where light receiving sensors S11 and S12 can detect the light rays radiated from halogen lamp 93A through the above-detailed light transmitting areas.

In FIG. 3, light receiving sensors S11 and S12 are mounted at positions to face both ends of belt supporting roller 93.

During the rotation of belt supporting roller 93, when first through-hole 93B and second through-hole 93C pass through positions to face light receiving sensors S11 and S12 respectively; when they are going to pass through said positions; or when they have passed through said positions, the light rays, radiated by halogen lamp 93A, enter light receiving sensors S11 and S12. In this specification, "the light rays are detected by the light receiving sensor" means not only "the light rays continuously enter the light receiving sensor", but also "the light rays intermittently enter the light receiving sensor".

In FIG. 3, light receiving sensor S11 is mounted near the right portion of belt supporting roller 93 (when viewed from the interior of image fixing belt 91), and detects the light rays coming through one or plural first through-holes 93B.

Further, light receiving sensor S12 is mounted near the left portion of belt supporting roller 93 (being viewed from the interior side of image fixing belt 91), and detects the light rays coming through one or plural first through-holes 93C.

If the interior surface of image fixing belt 91 has been contaminated with oil or grease, in order to prevent the oil or grease from reaching first through-hole 93B and second through-hole 93C, the diameter of portion 932, on which first through-hole 93B and second through-hole 93C are provided, may be configured to be less than the diameter of roller portion $\mathbf{93}_1$ of belt supporting roller 93, which is shown in FIG. 4.

Further, as shown in FIG. 5, the axial length of halogen lamp 93A may be configured to be extended to face first through-hole 93B and second through-hole 93C, in the width direction (which is the rotational axial direction) of image fixing belt 91. Due to the extension of halogen lamp 93A, the amount of light rays, passing through first through-hole 93B and second through-hole 93C, is increased.

Generally, the energy density of halogen lamp 93A, which heats the image fixing device, is very high. In order to detect the edge of image fixing belt 91, if the length of halogen lamp 93A is extended, the turning number of a coiled tungsten filament at the end portions of halogen lamp 93A is lower than that of the central heating portion of halogen lamp 93A. Since an excessive amount of light rays results in an increased thermal loss, the structure mentioned above is preferable from the view point of the heat efficiency.

Still further, on image fixing device 9 of the present embodiment, control section C is configured to detect the lateral displacement in the width direction of image fixing belt 91, (which is adverse deviation of the belt toward one side), based on the results detected by light rays receiving sensors S11 and S12.

In more detail, under the condition that a halogen lamp driving circuit has activated halogen lamp 93A, and during the time in which first through-hole 93B and second through-hole 93C pass through the positions to face light receiving sensors S11 and S12 at least one time, if both light receiving sensors S11 and S12 detect the light rays radiated from halogen lamp 93A, control section C is configured to determine that image fixing belt 91 is not deviating toward one side.

On the other hand, under the condition that a halogen lamp driving circuit has activated halogen lamp 93A, and during the time in which first through-hole 93B and second through-hole 93C pass through the positions to face light receiving sensors S11 and S12 at least one time, if either one of light receiving sensor S11 or S12 detects the light rays radiated from halogen lamp 93A, control section C is configured to determine that image fixing belt 91 is deviated toward one side, representing the side where a light receiving sensor, to which light rays have been blocked, exists.

Still further, under the condition that a halogen lamp driving circuit has activated halogen lamp 93A, and during the time in which first through-hole 93B and second through-hole 93C pass through the positions to face light receiving sensors S11 and S12 at least one time, if both light receiving sensors S11 and S12 do not detect the light rays radiated from halogen lamp 93A, control section C is configured to determine that any trouble has happened on the halogen lamp driving circuit, halogen lamp 93A, light receiving sensor S11 and S12, and a light receiving sensor driving circuit, after that, control section C conducts a problem recovering process.

By the above configuration, since light rays from halogen lamp 93A are detected under the stationary state, any problem to halogen lamp 93A as well as abnormal deviation of image fixing belt 91 can be detected, whereby the total reliability of the image forming apparatus is enhanced.

Concerning a device which controls the belt within a predetermined scope, by using a restricting member mounted near an end portion of the belt, or a device which controls the belt by using a force generated by the deviation of said belt, when a controlling means, such as control section C serving as a malfunction detection device, being used when said restricting member does not function well, detects any displacement across the width of the belt (which is the deviation of image fixing belt 91), control section C triggers an alarm to the operator, in response to which the operator conducts recovering action. Such a structure is also applicable to prevent the belt from being damaged.

Further, control section C is also configured to control the driving operation of image fixing belt 91, based on any detected displacement (which is the deviation of image fixing belt 91) of image fixing belt 91 across the width.

For example, control section C is configured in such a way that when control section C detects any displacement across the width of image fixing belt 91, control section C allows belt meander controlling roller 95 (which is a steering roller, for example) to be angled, so that any displacement of image fixing roller 91 can be corrected.

In more detail, control section C controls belt meander controlling roller 95 to angle toward a side where any one of light receiving sensor S11 or S12 receives the light rays from halogen lamp 93A, so that image fixing belt 91 is moved in the width direction of the belt, and moves back toward the normal position, from the deviated position.

In FIG. 3, under the condition that the halogen lamp driving circuit has activated halogen lamp 93A, and during a time in which first through-hole 93B and second through-hole 93C pass through the positions to face light receiving sensors S11 and S12 at least one time, if light receiving sensor S11 detects the light rays radiated from halogen lamp 93A, and light receiving sensor S12 does not detect the light rays from halogen lamp 93A, control section C controls belt meander controlling roller 95 to angle in arrowed direction X2.

On the other hand, under the condition that the halogen lamp driving circuit has activated halogen lamp 93A, and during the time in which first through-hole 93B and second through-hole 93C pass through the positions to face light receiving sensors S11 and S12 at least one time, if light receiving sensor S11 does not detect the light rays radiated from halogen lamp 93A, and light receiving sensor S12 does detect the light rays from halogen lamp 93A, control section C controls belt meander controlling roller 95 to angle in arrowed direction X1.

Generally, the interior surface of image fixing roller 93 is covered with a heat-resistant paint to prevent rust. If the interior surface of image fixing roller 93 is covered with a black heat-resistant paint, the light energy coming through first through-hole 93B and second through-hole 93C may not be intense enough.

Accordingly, the interior surfaces of image fixing roller 93, specifically near first through-hole 93B and second through-hole 93C, are covered with white paint, which exhibits a high reflecting ratio, and preferable wave lengths, exhibiting high sensitivity for light receiving sensor S11 and S12.

In the present embodiment, halogen lamp 93A is used as a heater, however, in image fixing device 9 (which is a belt driving device) relating to the present invention, any heat sources can be used, as long as it emits sufficient energy to be detected by light receiving sensors S11 and S12.

According to the first embodiment of the present invention, light receiving sensors S11 and S12 are configured not to touch image fixing belt 91, whereby no mechanical force is applied onto image fixing belt 91. Accordingly, any lateral displacement in the width direction of the belt can be detected, while image fixing belt 91 is less likely to be damaged.

Further, according to the first embodiment of the present invention, light receiving sensors S11 and S12 are not necessarily mounted in the interior area of image fixing belt 91, therefore, light receiving sensors S11 and S12, exhibiting low heat resistance, can detect any lateral displacement across the width, while being not affected by any contamination on the inner periphery of image fixing belt 91.

Still further, according to the first embodiment of the present invention, since light emitting element and its driving circuit are not needed, very few discrepant materials will exist, which results in higher reliability of the apparatus, as well as lower overall production cost.

[Variation 1]

Variation 1 of the present embodiment will now be detailed, while referring to FIGS. 6(A) and 6(B).

Concerning first through-hole 93B and second through-hole 93C, each hole is covered with light transparent member 93D (being heat resistant glass, for example).

In detail, a step portion is formed in each through-hole, on which said light transparent member 93D is glued with a heat resistant adhesive, which is shown in FIG. 6(B).

If an amount of light rays entering light receiving sensors S11 and S12 is very great, a neutral density filter exhibiting heat resistance will be used as said light transparent member 93D.

By variation 1, hot air is blocked off within first through-hole 93B and second through-hole 93C, resulting in less thermal loss.

Second Embodiment

Figure 7:
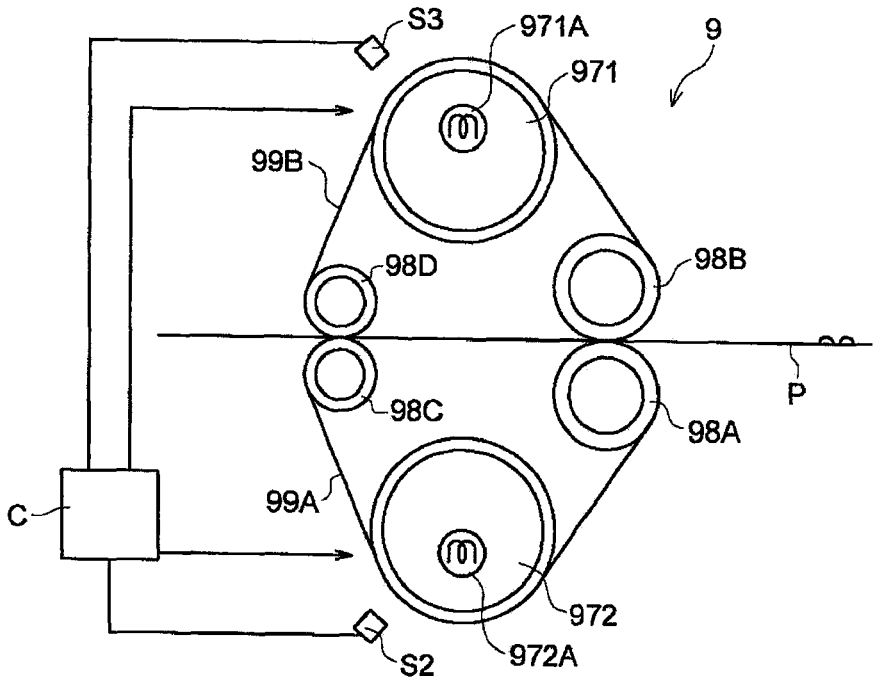
FIG. 7 is a cross-sectional view of the image fixing device, relating to a second embodiment of the present invention.

The second embodiment relating to the present invention, and in particular, the differences between the first and second embodiments, will now be detailed, while referring to FIG. 7. In the present embodiment, image fixing device 9, as shown in FIG. 7, is configured to function as the belt driving device relating to the present invention.

In FIG. 7, image fixing device 9 of the present embodiment includes endless fixing belts 99A and 99B. Endless fixing belt 99A is entrained about at least two supporting members (which are heating roller 972, and driving rollers 98A and 98C), while endless fixing belt 99B is entrained about at least two supporting members (which are heating roller 971, and driving rollers 98B and 98D). Light transmitting areas are provided on each heating roller 971 and 972. Halogen lamps 971A and 972A are housed in respective heating rollers 971 and 972.

The above-described light transmitting areas are provided through heating rollers 971 and 972, and halogen lamps 971A and 972A are housed within heating rollers 971 and 972, respectively.

Light receiving sensor S2 is mounted at a position on which light receiving sensor S2 can detect the light rays emitted from halogen lamp 972A and having passed through the light transmitting area, provided through heating roller 972. Light receiving sensor S3 is mounted at a position on which light receiving sensor S3 can detect the light rays emitted from halogen lamp 971A and having passed through the light transmitting area, provided through heating roller 971.

In addition, light receiving sensors S2 and S3 are mounted at positions to face both ends of heating rollers 971 and 972, respectively, which is in the same way as light receiving sensors S11 and S12 of the first embodiment.

Heating rollers 971 and 972 double as belt meander controlling rollers. When control section C detects the change of the light rays, detected by light receiving sensors S2 and S3, that is, when control section C detects the lateral displacement of image fixing belts 99A and 99B in the width directions, control section C is configured to control heating rollers 971 and 972 to be angled, so that the displacement of image fixing belts 99A and 99B can be corrected.

Specifically, when heating rollers 971 and 972 are angled, traveling direction of the light rays coming from the light transmitting areas tend to be altered, whereby said light rays may not expose light receiving sensors S2 and S3. Accordingly, light receiving sensors S2 and S3 are preferably mounted on the supporting members which are the same supporting members of heating rollers 971 and 972.

Third Embodiment

Figure 8:
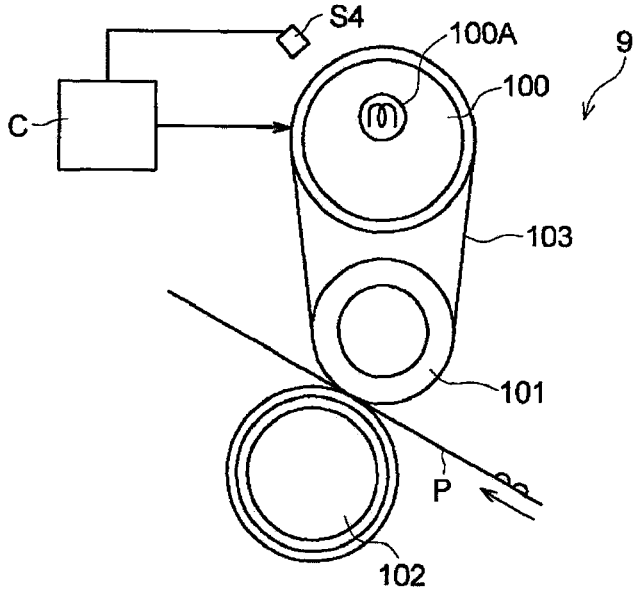
FIG. 8 is a cross-sectional view of the image fixing device, relating to a third embodiment of the present invention.

The third embodiment of the present invention, and in particular, the differences between the first and third embodiments, will now be detailed, while referring to FIG. 8. In the present embodiment, image fixing device 9 shown in FIG. 8 is configured to function as the belt driving device relating to the present invention.

In FIG. 8, image fixing device 9 of the third embodiment is configured in that endless image fixing belt 103 is driven, being entrained about at least two supporting members, (which are heating roller 100 and pressure applying roller 101).

Light transmitting areas are provided through heating roller 100, and halogen lamp 100A is housed within heating roller 100.

Light receiving sensor S4 is mounted on a position at which it can detect the light rays which were emitted from halogen lamp 100A and have passed through the light transmitting areas of heating roller 100.

In addition, separate light receiving sensors S4 are mounted near both end portions of heating roller 100 in the same way as light receiving sensors S11 and S12 of the first embodiment.

Heating roller 100 doubles as a belt meander controlling roller. When control section C detects the change of the light rays, detected by light receiving sensor S4, that is, when control section C detects the displacement of image fixing belt 103 in the width directions, control section C is configured to control heating roller 100 to be angled, so that the displacement of image fixing belt 103 can be corrected.

Fourth Embodiment

Figure 9:
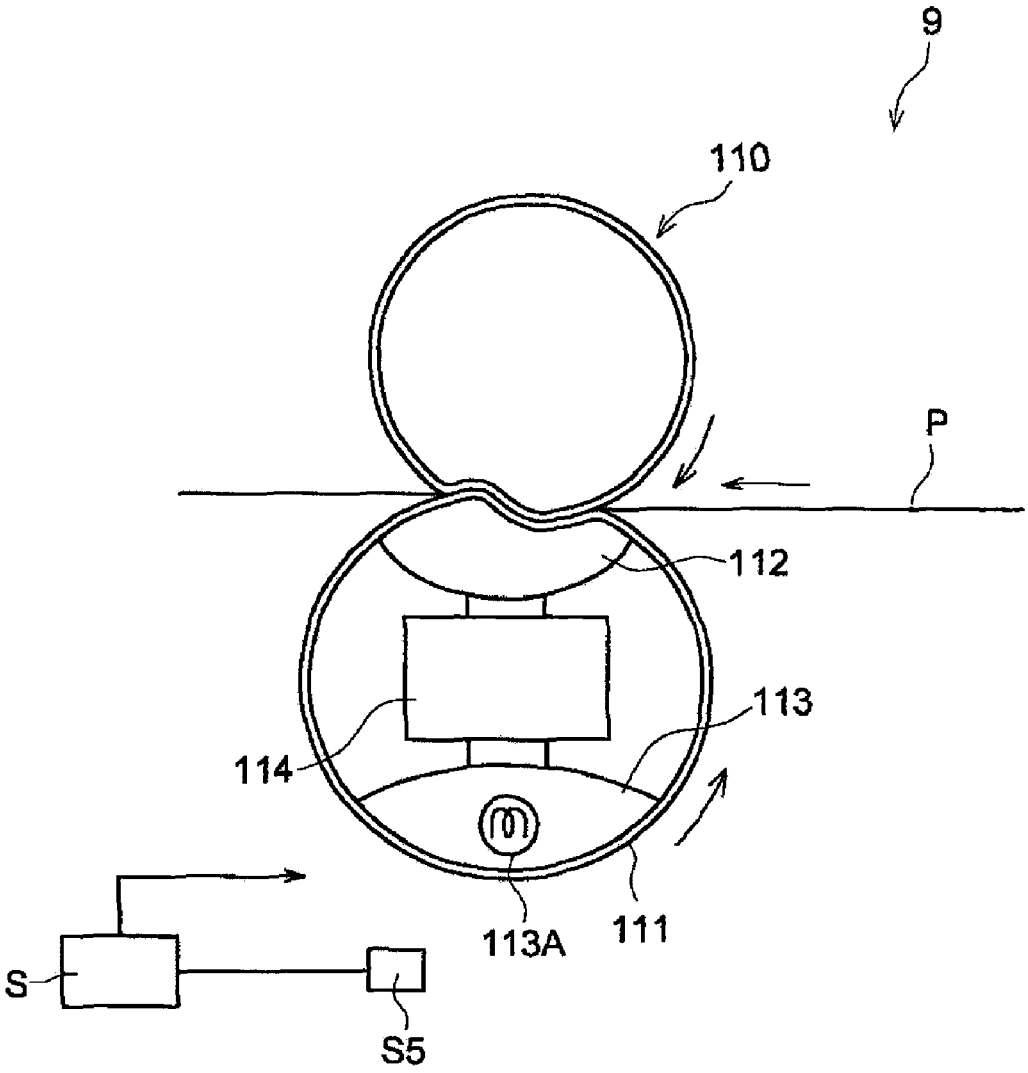
FIG. 9 is a cross-sectional view of the image fixing device, relating to a fourth embodiment of the present invention.

The fourth embodiment of the present invention, and in particular, the differences between the first and fourth embodiments, will now be detailed, while referring to FIG. 9. In the present embodiment, image fixing device 9 shown in FIG. 9 is configured to function as the belt driving device relating to the present invention.

In FIG. 9, image fixing device 9 of the fourth embodiment is configured in that endless image fixing belt 111 is driven, being entrained about pressure applying pad 112, and guide section 113.

Pressure applying pad 112 and guide section 113 are mounted on supporting frame 114, so that pressure applying pad 112 and guide section 113 do not rotate, being different from the first, second and third embodiments.

Light transmitting areas are provided through guide section 113, and halogen lamp 100A is housed within guide section 113.

Light receiving sensor S5 is mounted on a position at which it can detect the light rays which were emitted from halogen lamp 113A and have passed through the light transmitting areas on guide section 113.

In addition, light receiving sensors S5 is mounted near both end portions of guide section 113, in the same way as light receiving sensors S11 and S12 of the first embodiment.

When control section C detects the change of the light rays, detected by light receiving sensor S5, that is, when control section C detects lateral displacement of image fixing belt 111 in the width directions, control section C is configured to control guide section 113 to be angled, so that lateral displacement of image fixing belt 111 can be corrected.

In the present embodiment, since a belt meander controlling roller is provided, if control section C detects lateral displacement of image fixing belt 111 in the width direction, due to the detected result of light receiving sensor S5, control section C controls the belt meander controlling roller to be angled, so that any displacement of image fixing belt 11 can be recovered in the width direction.

In the above-described first embodiment through fourth embodiment, the distance between the light transmitting areas, formed on both end portions of the supporting roller, is configured to be greater than the width of the image fixing belt, so that when said belt meanders toward one side, said belt covers the light transmitting areas, and belt meander is detected by the light receiving sensor. However the present invention is not limited to this structure, that is, it is possible to configure the operation so that the distance between the light transmitting areas, formed on both ends of the supporting roller, is less than the width of the image fixing belt.

For example, when the image fixing belt moves in proper working order, the light rays, coming from both light transmitting areas, are covered by said belt. If said belt meanders, one of the light rays passing through the light transmitting areas are not covered by said belt, and any meander can be detected by the light receiving sensor.

In the above structure, since the light receiving sensors must be mounted to be slightly inside toward the center of the image fixing roller, the light receiving sensor requires higher heat resistance, which however does not reduce the efficiency of the present invention.

When the image fixing belt moves in proper working order, the light rays emitted from the heater (being the halogen lamp) do not leak outside, which improves the heat efficiency of the image fixing device, in addition, no member to prevent scattered light rays is necessary to be mounted within the image forming apparatus.

While the preferred embodiments of the present invention have been described using specific terms, such description is for illustrative purposes only, and it is to be understood that changes and variations may be made without departing from the spirit and scope of the appended claims.

What is claimed is:

1. An image fixing device, comprising: an endless belt which is entrained about at least two supporting members;

a first supporting member of the at least two supporting members, through which a light transmitting area is provided;

a heater which is housed within the first supporting member;

a sensor which is mounted at a position to detect light rays, emitted from the heater and passed through the light transmitting area; and a control section which is configured to detect a lateral displacement of the endless belt in a width direction, based on a detected result of the light rays, detected by the sensor.

2. The image fixing device of claim 1, wherein the control section is configured to correct a deviation of the endless belt in the width direction, based on a detected result of the lateral displacement in the width direction of the endless belt.

3. The image fixing device of claim 1, wherein at least one of the supporting members comprises a belt meander controlling roller.

4. The image fixing device of claim 1, wherein the light rays transmitting area comprises a through-hole provided on an end portion of the first supporting member.

5. The image fixing device of claim 4, wherein a first through-hole is provided on one end portion of the first supporting member, and a second through-hole is provided on another end portion of the first supporting member, wherein a distance between the first through-hole and the second through-hole is greater than a width of the endless belt, and when one of a first sensor facing the first though-hole and a second sensor facing the second through-hole does not detect the light rays, the control section is configured to detect the lateral displacement in the width direction of the endless belt.

6. The image fixing device of claim 4, wherein the distance between the first through-hole and the second through-hole is less than the width of the endless belt, and when one of a first sensor facing the first though-hole and a second sensor facing the second through-hole detects the light rays, the control section is configured to detect the lateral displacement in the width direction of the endless belt.

7. The image fixing device of claim 4, wherein the through-hole is covered with a light rays transmitting member.

8. The image fixing device of claim 1, wherein the sensor is mounted at a position which is outside the first supporting member and faces the light transmitting area.

9. An image forming apparatus, comprising:

an image forming section which forms toner image on a recording member; and an image fixing device, comprising:

an endless belt which is entrained about at least two supporting members;

a first supporting member of the at least two supporting members, through which a light transmitting area is provided;

a heater which is housed within the first supporting member;

a sensor which is mounted at a position to detect light rays, emitted from the heater and passed through the light transmitting area; and a control section which is configured to detect a lateral displacement of the endless belt in a width direction, based on a detected result of the light rays, detected by the sensor.

* * * * *